US005353728A

United States Patent [19]

Strange

[11] Patent Number: 5,353,728

[45] Date of Patent: Oct. 11, 1994

[54] CENTRALLY-LOCATED-BALLAST-TANK VESSEL

[75] Inventor: Booth B. Strange, Houston, Tex.

[73] Assignee: Marine Safety Systems Inc., Houston, Tex.

[21] Appl. No.: 168,764

[22] Filed: Dec. 17, 1993

[51] Int. Cl.[5] ..... B63B 39/03

[52] U.S. Cl. ..... 114/74 R

[58] Field of Search ..... 114/74 R

[56] References Cited

U.S. PATENT DOCUMENTS

| | | | |
|---|---|---|---|
| 3,745,960 | 7/1973 | Devine | 114/74 |
| 4,313,390 | 2/1982 | Yunoki et al. | 114/74 R |
| 4,960,347 | 10/1990 | Strange | 405/63 |
| 4,989,959 | 2/1991 | Conway | 114/74 |
| 5,018,113 | 5/1991 | Strange et al. | 367/127 |
| 5,213,054 | 5/1993 | Gallagher et al. | 114/74 R |

FOREIGN PATENT DOCUMENTS

| | | | |
|---|---|---|---|
| 21443 | of 1892 | United Kingdom | 114/74 R |

OTHER PUBLICATIONS

Reducing Tanker Accidents, Exxon paper, p. 16.
Tanker Spills, Reduction by Design, National Research Council pp. 43 and 89.
NTIS Report to Congress, PB93-128874, pp. 17 and 19
Federal Register, p. 54879.

*Primary Examiner*—Jesus D. Sotelo
*Attorney, Agent, or Firm*—William A. Knox

[57] ABSTRACT

An improved tanker ship construction design includes a plurality of liquid cargo tanks distributed in two longitudinal sets along each side of a tanker ship. A plurality of fully protected ballast tanks are distributed longitudinally between the sets of cargo tanks. A passive, gravity-responsive, fluid transfer system provides very rapid fluid communication between selected cargo tanks and a adjoining ballast tanks. A gravity responsive fluid transfer system is provided between the respective ballast tanks.

12 Claims, 4 Drawing Sheets

CENTRALLY-LOCATED-BALLAST-TANK VESSEL

BACKGROUND OF THE INVENTION

1. Field of the Invention

This invention is concerned with a novel hull construction for a liquid-cargo tanker ship. The hull construction provides means for self-rescue of cargo while maintaining floatation, proper load distribution, stability and trim in case of grounding or collision.

2. Discussion of Related Art

Tanker ships in general usually are built with the main cargo tanks arranged along each side of the centerline of the ship. Ballast tanks interspersed with additional cargo tanks form wing tanks outboard of the main cargo tanks. When the ship is fully loaded with cargo, the ballast tanks are normally empty because, if for no other reason, it is now illegal to carry cargo in a ballast tank. Thus, in the event of collision or grounding of a fully-loaded ship, one or more of the empty ballast tanks and/or the outboard cargo wing tanks take the brunt of the impact. Presumably with that arrangement, the centrally-located cargo tanks remain relatively undamaged and rapid cargo leakage is minimized.

What actually happens however is that a punctured external ballast tank(s), or for that matter the void in a double-hulled ship, is flooded with sea water, the unbalanced weight of which causes the ship to list and/or to capsize due to the loading imbalance.

Since today's tankers have no emergency transfer system, they must wait hours or even days for delivery of pumps and containment devices to regain trim, balance, load redistribution and floatation. That wait may prove to be catastrophic.

An Exxon Background Series paper entitled *Reducing Tanker Accidents* (1973), in a discussion of double-bottom ship grounding, stated at page 16 that ". . . This loss of buoyancy complicates freeing a stranded ship and increases the probability of suffering total loss . . . "

In the matter of conventionally-located segregated ballast tanks (SBT), at page 43 of *TANKER SPILLS, PREVENTION BY DESIGN,* published by the National Research Council, it is stated that ". . . For a given cargo volume, the ballast volume increases a great deal in SBT space—in the range of 234 to 334 percent—which is indicative of the additional area that must be protected from corrosion. The expected oil outflow in grounding increases by up to 90 percent in many SBT designs . . . "

Further at page 89 of the same volume, we read ". . . Chevron Shipping Company has demonstrated . . . that the damage stability of an 'industry standard' 130,000 DWT tanker greatly exceeds present [safety] criteria . . . A comparable double hull tanker, with interhull spacing of 2 meters and fully loaded, also *easily exceeds criteria* but can withstand less damage than the single hull design. When 96 percent loaded with heavy crude, the 2-meter double hull ship will capsize with only three tanks flooded . . . "

An NTIS report to Congress PB93-128874, page 17, illustrates the hull design of a conventional single-hull ship with outboard wing ballast tanks. When sailing filled with cargo, the ballast tanks of the tanker are empty. If a ballast tank on one side of the ship is damaged and becomes water-flooded, the effect on the ship's lateral stability of the loading imbalance is evident from the drawing.

U.S. Pat. No. 4,960,347 issued Oct. 2, 1990 to Booth B. Strange and assigned to the assignee of this invention, provides a normally empty, emergency holding tank and a cargo transfer system for moving liquid cargo from a damaged cargo tank to the holding tank. The placement of the holding tank is such that the ship's stability is not seriously affected. The liquid cargo that is removed from the damaged tank is replaced to some extent by seawater; a water seal is quickly established in the damaged region so that the damaged tank need be only partially emptied. Therefore, the total ship's displacement is not significantly altered. The teachings of the '347 patent are incorporated herein by reference.

U.S. Pat. No. 4,389,959 issued Jun. 28, 1983 to C. S. Conway teaches a system for removing liquid cargo from a damaged tank to create a water seal over the leak although he does not provide positive means for disposal of whatever liquid cargo is removed.

The patents cited assume a single-hulled tanker but one that has no outboard ballast tanks such as exist in the real world. Those references failed to consider the effects on ship's trim, in the presence of one or more flooded outboard ballast tanks.

*The Federal Register* for Friday, Oct. 22, 1993 mentions an as-yet untried Emergency Rapid Transfer System (ERTS). According to the text at page 54879, the ERTS consists of pipes and blank flanges that connect cargo tanks to ballast tanks. When damage occurs and the cargo tank level drops, sensors automatically cause the flange bolts to be ruptured. Cargo flows rapidly from the damaged cargo tanks into the empty ballast tank by force of gravity.

There are distinct disadvantages to the ERTS system in that the oil flow is uncontrolled and apparently can not be shut off when and if necessary. The presence of explosive bolts creates a fire hazard In the presence of an accident, it is important to know the location of a damaged tank(s). U.S. Pat. No. 5,018,113 issued May 21, 1991 to Booth B. Strange et al. and assigned to the assignee of this invention teaches a method for locating a damaged tank using acoustic means.

U.S. Pat. No. 3,745,960, issued Jul. 17, 1973 to W. B. Devine teaches the concept of locating the ballast tanks along the centerline of a tanker. The ballast tanks are interspersed with cargo tanks and may be used for both cargo and ballast at the user's option.

In the above-cited NTIS report, page 19, there is shown the "POLMIS" tanker. External void spaces are provided outboard of the cargo tanks. A bladder-type ballast bag occupies a portion of a centrally-located cargo tank. Damage to, and subsequent water flooding of the void spaces could be disastrous.

For purposes of brevity but not by way of limitation, the terms "liquid cargo", "fluid cargo" or other similar phrases may be replaced by the word "oil".

There is a need for an improved hull design for an oil tanker ship that, if damaged, retains the following capabilities:

1. No significant loss of floatation;
2. No substantial disruption of the optimal load distribution;
3. No loss of trim due to unbalanced loading; and
4. No flow of oil into confined areas such as a ruptured ballast tank or the inter-hull voids in a double-hulled ship, It is an object of this invention to provide a tanker-ship construction design that consists of a row of interconnected protected, inerted ballast tanks along the centerline of a tanker ship, flanked on each side by sets of cargo tanks.

SUMMARY OF THE INVENTION

This invention teaches an improved construction for an oil tanker hull. A plurality of liquid cargo wing tanks are distributed in two sets, one set along each side of the hull. A plurality of ballast tanks are distributed longitudinally in a row along the centerline of the hull between the sets of cargo tanks. The ballast tanks are separated from the liquid cargo tanks by longitudinal bulkheads. A passive, gravity-responsive liquid cargo transfer system provides very rapid fluid communication between damaged liquid cargo tanks and adjoining inerted ballast tanks.

In one aspect of this invention, the liquid cargo transfer system includes at least one remotely-actuable large-diameter gate valve that forms a normally-closed port in the bulkhead separating a ballast tank from a liquid cargo tank. Two valves may be employed including an upper valve that is located even with or just below the Plimsol line on the hull. A second valve is located near the mid-depth of the cargo tank. The remotely controlled valves provide controllable fluid communication between cargo and ballast tanks.

BRIEF DESCRIPTION OF THE DRAWINGS

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention.

DETAILED DESCRIPTION OF THE PREFERRED EMBODIMENT

Figure 1:
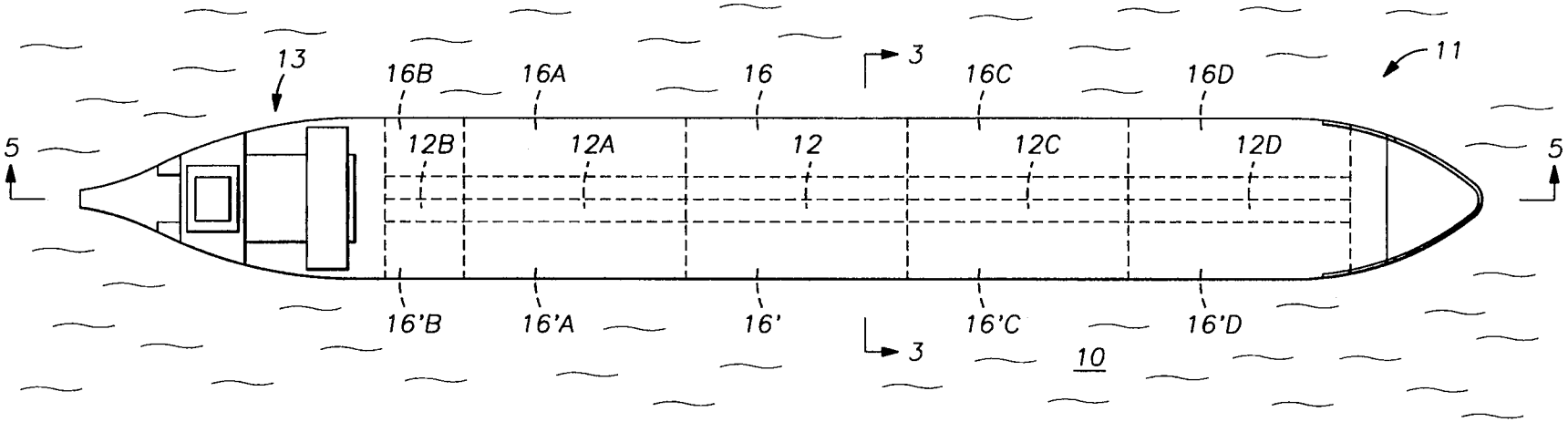
FIG. 1 is a plan view of a tanker ship having a hull construction according to this invention.
Figure 2:
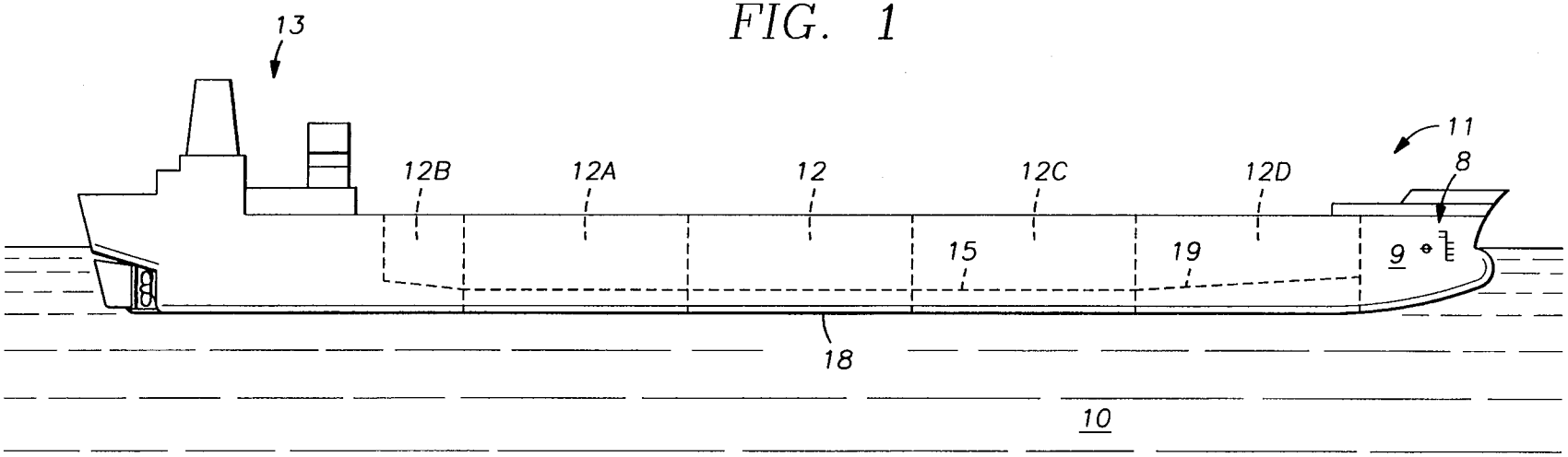
FIG. 2 is a side view of the ship of FIG. 1, showing centrally-located ballast tanks in phantom outline as dashed lines.

Referring now to FIGS. 1 and 2, there are shown plan and side views of the preferred construction of a tanker ship 11 having a hull 9, immersed to its Plimsol line 8 in a body of water 10. A plurality of cargo wing tanks for containing oil are distributed in two sets, 16–16D and 16′–16′D, one set on each side of hull 9. A row of ballast tanks 12–12D, shown in phantom outline as dashed lines in FIG. 2 are, in contrast to conventional design, distributed longitudinally midships along the centerline of the hull between the two sets of cargo tanks 16–16D and 16′–16′D. The respective ballast tanks are separated from the cargo tanks by longitudinal bulkheads such as 24 and 24′. The ballast tanks are separated from each other by transverse bulkheads such as 25 and 25′. The bottom, 15, of a ballast tank such as 12, clears the bottom, 18, of the ship 11 by a space at least equal to one-tenth of the beam of the ship.

Figure 3:
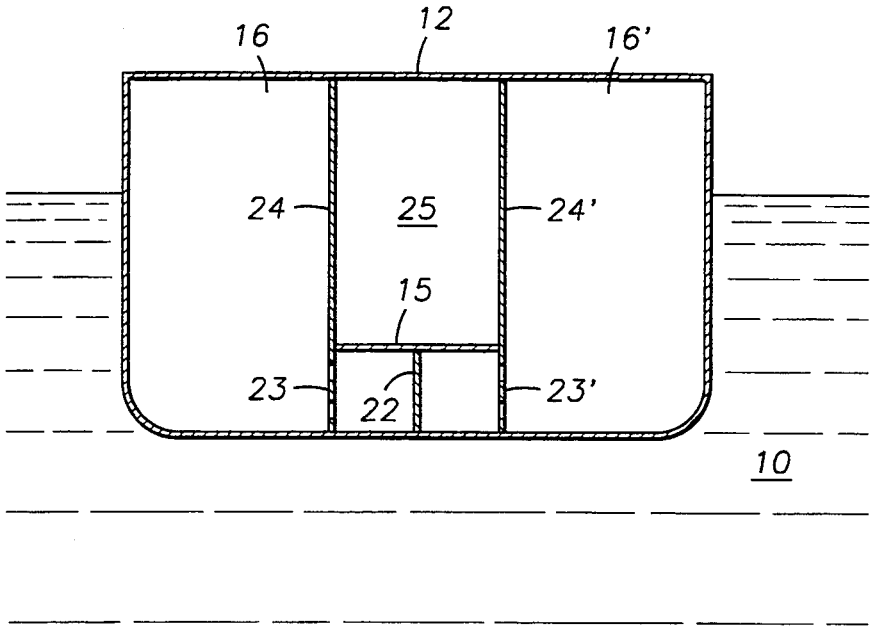
FIG. 3 is a transverse cross section of the ship along line 3—3 of FIG. 1.

FIG. 3 is a cross section along line 3—3 of FIG. 1 showing a typical ballast tank 12 flanked by two adjacent outboard wing cargo tanks 16 and 16′. The bottom, 15, of ballast tank 12 is supported above ship's bottom 18 by a rib 22. Optional extensions 23 and 23′ of bulkheads 24 and 24′ lend longitudinal rigidity to the vessel. The extensions may be solid so as to form a service tunnel beneath the ballast tanks for plumbing and other utilities or the extensions may be perforated to provide additional volume for the cargo tanks. Ballast tank 12 is shown with rectangular outline but it could be trapezoidal with the wider portion at the base to lower the center of gravity when the ship is sailing with empty cargo tanks, under ballast. Ten cargo tanks and five ballast tanks are shown by way of example but not by way of limitation. The actual number and capacities of the tanks are, of course, a matter of the tanker size naval and design principles.

The bottom, 19, of the forwardmost ballast tank may be tapered upwards at an arbitrary angle for better protection in the event of a head-on grounding. Additional protection could be afforded by armor-plating the forward portion of the hull bottom. Disposing the ballast tanks inboard of the cargo tanks and well above the ship's bottom eliminates the probability of puncturing an empty ballast tank. Even if a centrally-located ballast tank should indeed actually be damaged, subsequent water flooding would not affect the ship's stability.

Preferably, cargo tanks are not interspersed between the individual centered ballast tanks as has been suggested by the '960 reference previously discussed, nor are the ballast tanks of this disclosure ever used to transport cargo except in emergency.

In the drawings, pumps and plumbing used for normal oil transfer and off-loading are not shown. The ship's propulsion machinery, pilot house, crew living quarters and on-deck ship-handling equipment are merely indicated schematically in outline at 13 because those items are not germane to this invention.

There are two key considerations to be considered in event of an accident. The first is, of course identification of the damaged cargo tank. That matter was addressed in the '113 reference, previously cited.

Additional damage-location devices include means for monitoring and telemetering cargo-status information from each cargo tank to the pilot house. Indicators such as a liquid-level sensor and a pressure sensor, installed in each cargo tank, furnish an alarm capability in the presence of a change in the status of the contents of a tank(s). Similar instrumentation may be installed in the ballast tanks to monitor whatever fluids are contained therein. For ease of tank identification, especially in event of a collision, each tank includes an external identity marker and bulkhead position lines visible from the pilot house.

The second consideration in an emergency is to provide an immediate self-rescue capability in the form of a cargohandling and fluid redistribution means. The '347 reference previously cited teaches an active self-rescue method. An attractive alternative to the above is a passive gravity-responsive mechanical transfer system illustrated in FIGS. 4 through 7.

Figure 6:
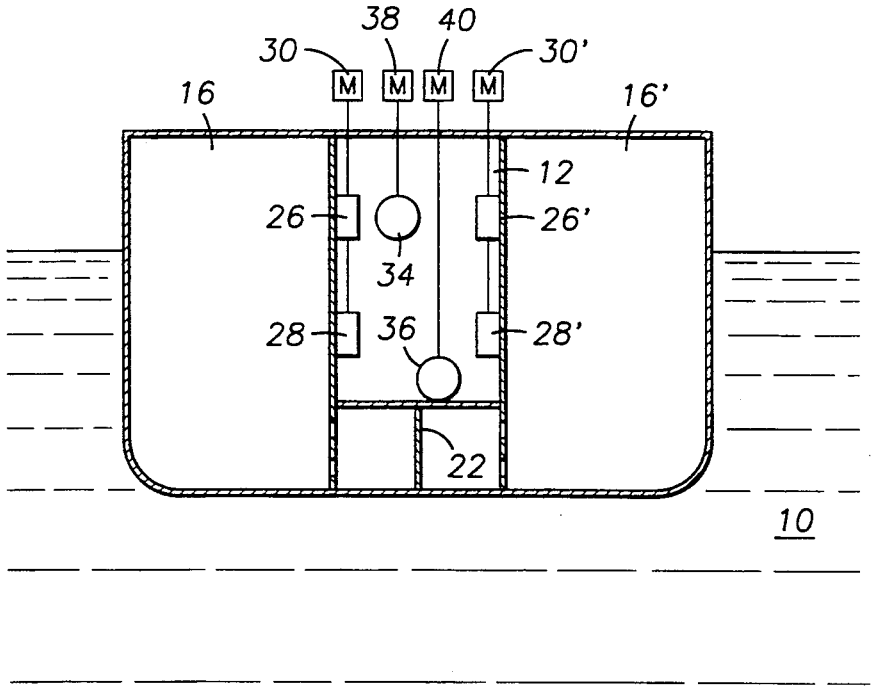
FIG. 6 is a transverse cross section of a ballast tank along lines 6—6 of FIG. 5.
Figure 4:
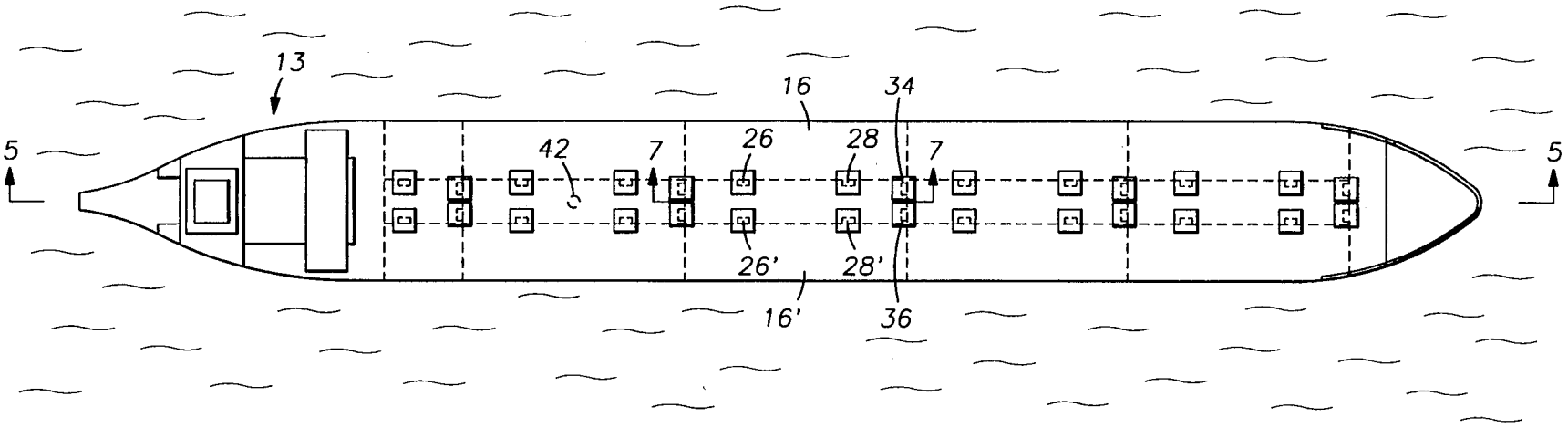
FIG. 4 is a plan view of the tanker of FIG. 1 including a passive, gravity-responsive liquid transfer system.
Figure 5:
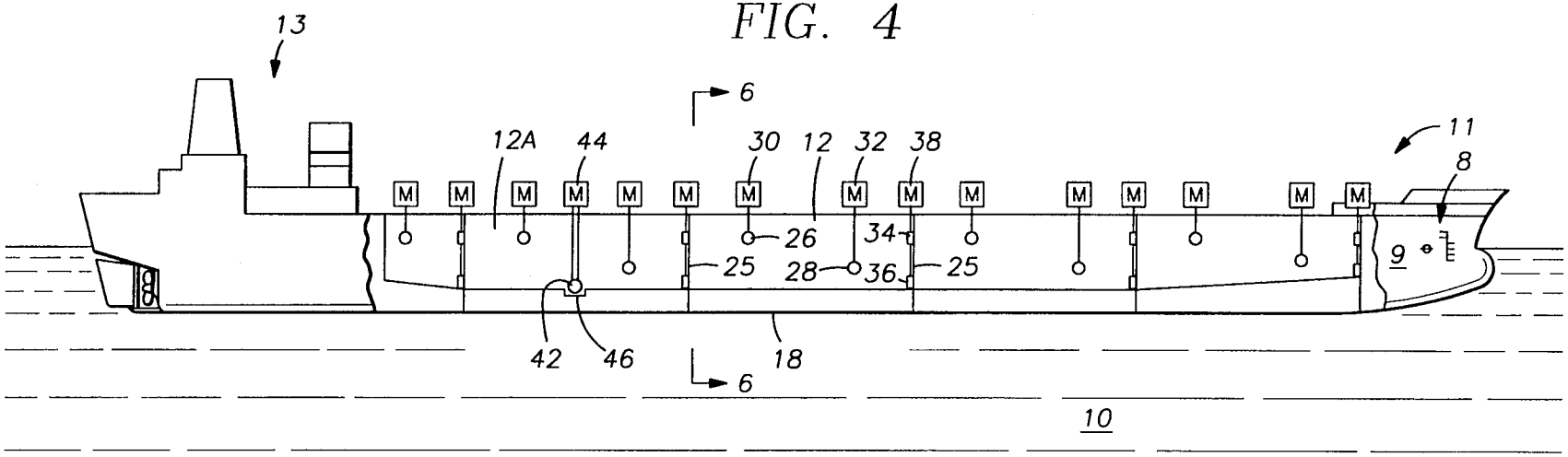
FIG. 5 is a partially-cutaway cross section of the ship along line 5—5 of FIG. 4 showing the installed locations of the valves that comprise the passive transfer system and the submersible pump means for off loading transferred cargo from a ballast tank.
Figure 7:
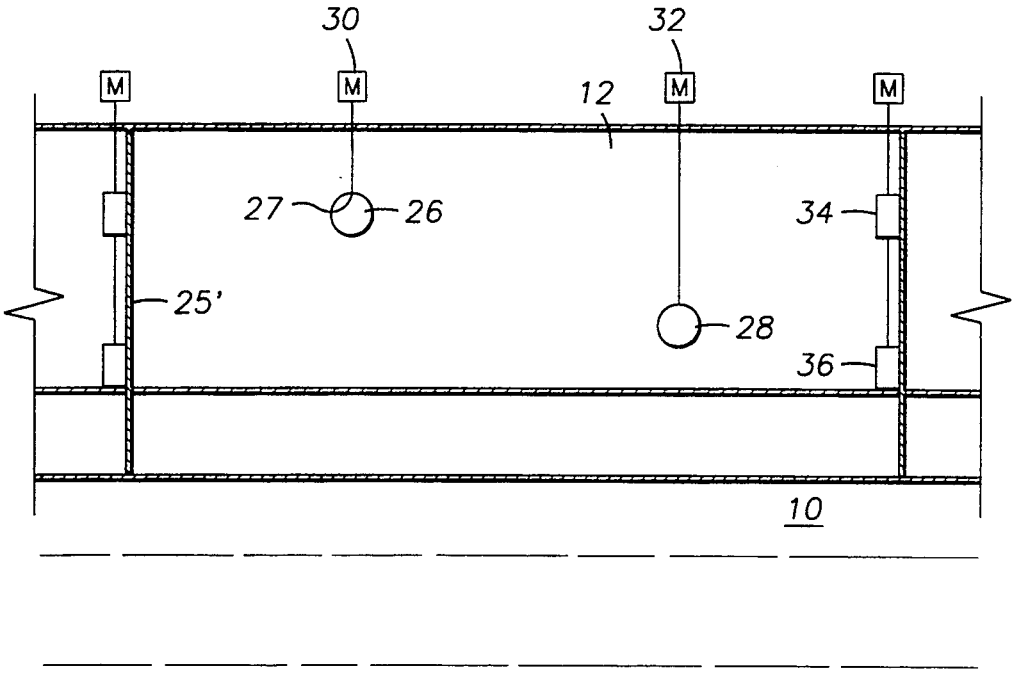
FIG. 7 is a longitudinal cross section of the ship along lines 7—7 of FIG. 4.

FIG. 4 is a copy of FIG. 1 showing schematically the positioning of the valving involved in the passive transfer system. FIG. 5 is a partial cutaway cross section of FIG. 4 along lines 5—5. FIGS. 6 and 7 are cross sections along lines 6—6 of FIG. 5 and lines 7—7 of FIG. 1

Referring to FIGS. 4 through 7 collectively, two large-diameter gate valves 26 and 28 are mounted over apertures cut in each of the bulkheads 24 and 24' that separate ballast tank 12 from the adjacent cargo tanks 16 and 16'. The valves in bulkhead 24 form normally-closed ports that can be actuated by remote control to provide controlled fluid communication between ballast tank 12 and a selected adjacent liquid cargo tank such as 16 or 16'. The top, 27, of the internal fluid passageway of a valve such as 26 is coincident or just below the Plimsol line 8 marked on the hull of ship 11. The second valve 28 between tank 12 and the adjoining cargo tank is mounted beneath valve 26 but offset laterally therefrom and located near the mid point of the cargo-tank depth.

A suitable valve for the above application is a Catalog-FIG. 30 ROVALVE, Stainless steel body, wedge gate valve, made by W. G. Rovang and Associates of Portland Oreg. That valve is available in sizes up to 48". The term "large" refers to valves having a clear aperture, when open, of several square feet.

The gate valves such as 26 and 28 in the respective ballast tanks may be individually or collectively operated remotely by electric or hydraulic motors such as 30 and 32, controlled from the pilot house. Preferably an actuating motor for each valve is located on-deck and is coupled to an extension of the valve stem by any convenient means to open or close the corresponding valve. A similar valve assembly such as 26' and actuating motor 30' is provided for bulkhead 24'. Although not shown in the drawings, standpipes coupled to valves 26 and 28, extending to the bottom 15 of ballast tank 12 may be provided.

Valves 34 and 36 which may also be ROVALVE gate valves of suitable size, actuated by motors 38 and 40, are installed in each transverse bulkhead such as 25 for providing optional fluid inter-communication between ballast tanks. By that means the crew can equalize the oil level within the respective ballast tanks to maintain fore-and-aft ship's trim. Those valves may be operated by remote control electrically or hydraulically.

The valving as above described forms a gravity-responsive passive cargo transfer system to furnish a self-rescue capability. The system was described with particular reference to ballast tank 12 and cargo tanks 16 and 16' but such a system is installed in each one of the other ballast and cargo tanks.

A submersible pump 42, whose capacity exceeds a flow rate on the order of 10,000 gallons per minute (FIG. 5) powered by a surface-mounted electric or hydraulic motor 44 and controllable from the pilot house, is provided in at least one of the ballast tanks such as 12A (FIG. 1), which is preferably near the aft end of the vessel. The purpose of pump 42 is to off-load whatever oil has accumulated in the row of ballast tanks. If desired, the bottom of ballast tank 12A could be arranged to form a sump 46 for receiving effluent from the other ballast tanks.

In the event of an emergency up to 60% of the total cargo could be jettisoned into the ballast tanks not only from a damaged cargo tank but also from other cargo tanks in whatever volume is needed to lighten the ship. Pump 42 will then be used for timely emergency offloading of the jettisoned cargo from the ballast tanks to lighters or other scavenging means.

The POLMIS tanker of the NTIS report earlier cited discloses a centrally-located ballast bag. From practical standpoint, it is unsuitable for use with the design of this invention. That ballast bag is immersed inside a fully-loaded cargo tank, beneath the oil surface. No apparent means are shown for transferring oil from a cargo tank into the ballast bag. Assuming the POLMIS ship to be fully loaded, the ballast bag would necessarily be empty so that the bag in actual fact would be collapsed under the mass of the oil above it. Gravity flow from a cargo tank to the ballast bag would be impossible.

The best mode of operation will now be explained with reference to FIG. 8. A gash 47 was accidentally ripped into the ship's hull in cargo tank 16. Water 48 flowing into tank 16 through gash 47 displaces the less-dense oil 50 upwards. Valves 26 and 28 are opened from the wheel house. The displaced oil 50 gushes very rapidly into ballast tank 12 through open valves 26 and 28 until hydrostatic equilibrium is established between the contents of tank 12 and the external water pressure head. Further flow may be terminated as soon as a water seal above the gash has been established. The term "very rapidly" means, for example, flow rates on the order of 3000 to at least 8000 gallons per minute.

Figure 8:
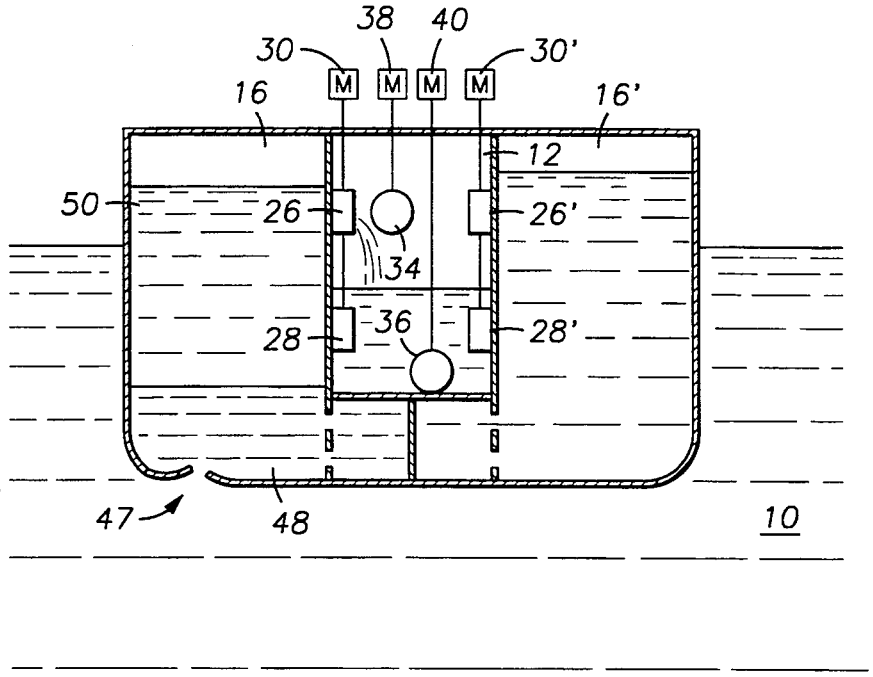
FIG. 8 is a view similar to FIG. 7, showing cargo being transferred from a leaking cargo tank into a centrally-located ballast tank.

Ordinarily, in a fully-loaded ship, the oil level inside an intact tank such as 16', FIG. 8, is higher than the external water line in proportion to the difference in specific gravity between the two liquids. The combined mass of the water and oil in tank 16, when in hydrostatic balance, will equal the mass of the oil in tank 16' so that the lateral trim of the ship remains substantially in balance. The mass of the oil displaced into ballast tank 12 is centered over the keel so that the ship remains stable.

By operation of valves such as 34 and 36 between ballast tanks, the displaced oil can be distributed by gravity flow along the fore-and-aft axis of the ship. Judicious redistribution may be useful, by way of example but not by way of limitation, in the event that the bow of the ship is grounded with a concomitant rupture of a forward cargo tank. After displaced oil has been transferred from the forward cargo tank to the forward ballast tanks, the bow can be lightened slightly by allowing oil to flow from the forward ballast tanks to ballast tanks towards the after end of the ship, thereby to help the ocean tide, if present, to dislodge the ship's bow from an obstruction. The redistribution of oil in the ballast tanks takes place by gravity flow through remotely controlled valves 34 and 36.

This invention has been described with a certain degree of specificity by way of example but not by way of limitation. Those skilled in the marine arts will readily consider variations is the vessel construction taught herein but which will fall within the scope of this disclosure. The teachings herein are limited only by the appended claims. For example, each ballast tank is shown as flanked by a mating coextensive cargo tank on each side. Other designs might include an arrangement wherein one cargo tank is coextensive with two or more separate ballast tanks. Alternatively, a single ballast tank might be coextensive with more than one cargo tank.

What is claimed is:

1. An improved tanker ship construction method, the ship including a hull marked by a Plimsoll line, comprising:

constructing a plurality of cargo tanks for containing liquid cargo, the tanks being distributed in two longitudinal sets, one set of cargo tanks along each side of said hull;

constructing a plurality of ballast tanks that are distributed in a row longitudinally along the centerline of said hull midships between said sets of cargo tanks, said ballast tanks being separated from each other by transverse bulkheads and from adjacent cargo tanks by longitudinal bulkheads; and installing a passive, gravity-responsive liquid transfer system means between each said ballast tank and selected ones of said plurality of cargo tanks.

2. The tanker ship construction method as defined by claim 1, wherein:

said passive gravity-responsive transfer system means includes at least one large, remotely-actuable gate valve, having an internal horizontally-disposed fluid passageway, said valve forming a normally closed port in a longitudinal bulkhead between a selected one of said cargo tanks and at least one of said ballast tanks, said remotely-actuable gate valve being operable to provide controlled rapid fluid communication between said ballast tank and said selected cargo tank.

3. The tanker ship construction method as defined by claim 2, comprising:

installing at least one remotely-actuated normally-closed valve means in the transverse bulkheads separating each said ballast tank for providing optional gravity-responsive fluid intercommunication between said plurality of ballast tanks.

4. The tanker ship construction method as defined by claim 3, wherein:

said horizontally-disposed internal fluid passageway of said at least one gate valve includes a top portion that is substantially coincident with said Plimsoll line.

5. The tanker ship construction method as defined by claim 1, wherein:

said passive gravity-responsive fluid transfer system means includes at least two large remotely-controllable gate valves that form normally-closed ports in a longitudinal bulkhead between each said cargo tank and each said adjacent ballast tank, said remotely-controlled valves being operable to provide controlled rapid fluid communication therebetween.

6. The tanker ship construction method as defined by claim 1, wherein:

said passive gravity-responsive fluid transfer system means includes at least one remotely-controlled gate valve that forms a normally closed port in a longitudinal bulkhead between each said cargo tanks and each said adjacent ballast tank, said at least one remotely-actuable gate valve being operable to provide controlled fluid communication therebetween.

7. The tanker ship construction method as defined by claim 4, comprising:

installing a high-volume submersible pump means for off-loading from said ballast tanks liquid cargo transferred thereto from a damaged cargo tank.

8. The tanker ship construction method as defined by claim 4, comprising:

installing a means for off-loading accumulated effluent from said row of ballast tanks.

9. The tanker ship construction method as defined by claim 8, wherein:

said means for off-loading is a high-capacity submersible, remotely-actuable pump installed in a sump formed in one tank of said row of ballast tanks.

10. An improved liquid cargo vessel construction method, the vessel including a hull, comprising:

constructing a plurality of cargo tanks for containing liquid cargo, the cargo tanks being distributed in longitudinal sets, at least one set of cargo tanks along each side of said hull;

constructing a plurality of ballast tanks that are distributed in a row longitudinally along the centerline of said hull between said sets of cargo tanks, said ballast tanks being separated from each other by transverse bulkheads and from adjacent cargo tanks by longitudinal bulkheads; and installing a passive, gravity responsive liquid-cargo transfer system means between each said ballast tank and selected ones of said plurality of cargo tanks.

11. The liquid cargo vessel construction method as defined by claim 10, wherein:

said passive gravity-responsive transfer system means includes at least one large, remotely-actuable gate valve, said valve forming a normally closed port in a longitudinal bulkhead between a selected one of said cargo tanks and at least one of said ballast tanks, said remotely-actuable gate valve being operable to provide controlled rapid flow of fluid between said ballast tank and said selected cargo tank.

12. The liquid cargo vessel construction method as defined by claim 11 comprising:

installing at least one remotely-actuated normally-closed valve means in each one of said transverse bulkheads separating the respective ballast tanks for providing optional gravity-responsive fluid intercommunication between said plurality of ballast tanks.

* * * * *